US007967150B2

(12) United States Patent
Yamazaki et al.

(10) Patent No.: US 7,967,150 B2
(45) Date of Patent: Jun. 28, 2011

(54) CENTRIFUGATION DEWATERING APPARATUS

(75) Inventors: Akira Yamazaki, Nagaoka (JP); Yoshimi Ohtaki, Nagaoka (JP); Masaki Takato, Nagaoka (JP)

(73) Assignee: Echigoseika Co., Ltd, Niigata (JP)

( * ) Notice: Subject to any disclaimer, the term of this patent is extended or adjusted under 35 U.S.C. 154(b) by 86 days.

(21) Appl. No.: 11/915,449

(22) PCT Filed: Dec. 20, 2005

(86) PCT No.: PCT/JP2005/023380

§ 371 (c)(1), (2), (4) Date: Mar. 10, 2009

(87) PCT Pub. No.: WO2007/013192

PCT Pub. Date: Feb. 1, 2007

(65) Prior Publication Data

US 2009/0211961 A1 Aug. 27, 2009

(30) Foreign Application Priority Data

Jul. 25, 2005 (JP) ..... 2005-214658

(51) Int. Cl.
*B04B 3/00* (2006.01)
*F26B 5/08* (2006.01)

(52) U.S. Cl. ..... 210/360.1; 494/26

(58) Field of Classification Search ..... 210/360.1, 210/380.1; 494/23, 25, 26; 34/58, 60
See application file for complete search history.

(56) References Cited

U.S. PATENT DOCUMENTS 5,318,360 A * 6/1994 Langer et al. ..... 366/317
5,771,601 A * 6/1998 Veal et al. ..... 34/314
5,956,858 A * 9/1999 Veal et al. ..... 34/58

FOREIGN PATENT DOCUMENTS

JP 38-6093 4/1963
JP 38-6093 Y 4/1963
JP 59-76564 A 5/1984
JP 60-7950 A 1/1985

(Continued)

*Primary Examiner* — Fred Prince
(74) *Attorney, Agent, or Firm* — Sughrue Mion, PLLC

(57) ABSTRACT

According to the present invention, there is provided a centrifugation dewatering apparatus that is capable of using a flow of air to dry a material to be dewatered while the material is being subjected to centrifugation dewatering. A centrifugation dewatering apparatus has a water-draining basket (2) for accommodating a material to be dewatered (i), and the water-draining basket (2) is rotatably provided to an apparatus main body (3). The water-draining basket (2) is rotatably driven, whereby water that has adhered to the material to be dewatered (i) is centrifugally removed. A hollow rotating shaft part (5) that is caused to rotate using a drive source (4) is vertically provided to the apparatus main body (3). The water-draining basket (2), which rotates in tandem with the rotating shaft part (5), is provided to a periphery of the rotating shaft part (5). The interior of the hollow rotating shaft part (5) and the interior of the water-draining basket (2) are provided in a communicating state. Air introduced into the rotating shaft part (5) is introduced into the water-draining basket (2) via the interior of the rotating shaft part (5) when the material to be dewatered (i) that is accommodated in the water-draining basket (2) is centrifugally dewatered by the rotation of the rotating shaft part (5) as provided by the drive source (4). The material to be dewatered (i) is dried using the air flow and the centrifugal force.

5 Claims, 4 Drawing Sheets

FOREIGN PATENT DOCUMENTS

| | | | |
|---|---|---|---|
| JP | 62-204899 | A | 9/1987 |
| JP | 4-281869 | A | 10/1992 |
| JP | 5-68913 | A | 3/1993 |
| JP | 5-84055 | A | 4/1993 |
| JP | 05-192594 | A | 8/1993 |
| JP | 5-309125 | A | 11/1993 |
| JP | 7-135940 | A | 5/1995 |
| JP | 7-144150 | A | 6/1995 |
| JP | 7-289219 | A | 11/1995 |
| JP | 9-215732 | A | 8/1997 |
| JP | 9-215733 | A | 8/1997 |
| JP | 9-313575 | A | 12/1997 |
| JP | 10-33643 | A | 2/1998 |
| JP | 2004-66212 | A | 3/2004 |
| JP | 2004-225279 | A | 8/2004 |
| WO | 92-15335 | A1 | 9/1992 |
| WO | 03/105208 | A1 | 12/2003 |

* cited by examiner

CENTRIFUGATION DEWATERING APPARATUS

TECHNICAL FIELD

The present invention relates to a centrifugation dewatering apparatus enabling a material to be dewatered to be simultaneously dried and dewatered using centrifugation.

BACKGROUND ART

Centrifugation dewatering apparatuses are conventionally used, e.g., to dewater and remove large quantities of rice that have been wettened as a result of having been washed with water when processed (e.g., refer to Patent Document 1).

Centrifugation dewatering apparatuses typically have a water-draining basket for accommodating a material to be dewatered, and this basket is rotatably provided to the main body of the apparatus. The water-draining basket is rotatably driven, and any water adhering to the material to be dewatered is removed through centrifugation.

[Patent Document 1] Japanese Laid-Open Patent Application 5-192594

DISCLOSURE OF THE INVENTION

Problems that the Invention is Intended to Solve

However, when dewatering is performed using a centrifugation dewatering apparatus of such description, a certain amount of the water will be removed, but the surface of the rice substantially remains wet.

Occasionally, therefore, rice grains will stick together even after the dewatering has been performed, or, when the dewatered rice is conveyed using conveying equipment, measured using measuring devices, or otherwise handled, the rice will end up sticking to the devices. Work progress is accordingly impeded. A further problem is presented insofar as rice that has adhered to devices along a manufacturing line becomes microbiologically unstable, which leads to degradation of the end product.

Such issues can theoretically be resolved by subjecting the rice to a flow of air or heat-assisted drying after the rice has been centrifugally dewatered; however, the procedures required for such drying steps are complex, which raises concerns related to diminished productivity. In addition, if the procedures are not properly performed, non-uniform drying will result. Accordingly, these are unrealistic solutions for such problems.

With the foregoing in view, it is an object of the present invention to provide an innovative centrifugation dewatering apparatus that resolves the aforesaid problems, and makes it possible to dry a material to be dewatered while the material is being subjected to centrifugation dewatering.

Means Used to Solve the Above-Mentioned Problems

The main points of the present invention are described below with reference to the accompanying drawings.

A first aspect of the present invention relates to a centrifugation dewatering apparatus wherein a water-draining basket 2 for accommodating a material to be dewatered 1 is rotatably provided to an apparatus main body 3, and the water-draining basket 2 is rotatably driven, thereby centrifugally removing water that has adhered to the material to be dewatered 1. The centrifugation dewatering apparatus of the first aspect is characterized in that a hollow rotating shaft part 5 that is caused to rotate using a drive source 4 is vertically provided to the apparatus main body 3; the water-draining basket 2, which rotates in tandem with the rotating shaft part 5, is provided to the periphery of the rotating shaft part 5; the interior of the hollow rotating shaft part 5 and the interior of the water-draining basket 2 are provided in a communicating state; air introduced into the rotating shaft part 5 is introduced into the water-draining basket 2 via the interior of the rotating shaft part 5 when the material to be dewatered 1 that is accommodated in the water-draining basket 2 is centrifugally dewatered by the rotation of the rotating shaft part 5 as provided by the drive source 4; and the material to be dewatered 1 is dried using the air flow and the centrifugal force.

A second aspect of the present invention relates to the centrifugation dewatering apparatus of the first aspect, and is characterized in that an air flow fin 6 that rotates in tandem with the rotation of the rotating shaft part 5 is provided; and in that the position in which the air flow fin 6 is attached as well as the configuration thereof are established so that air within the rotating shaft part 5 is guided into the water-draining basket 2.

A third aspect of the present invention relates to the centrifugation dewatering apparatus of the first or second aspect, and is characterized in that the air flow fin 6 that rotates in tandem with the rotation of the rotating shaft part 5 is provided; and that the air flow fin 6 creates an air-drawing current introduced from the exterior of the rotating shaft part 5 into the interior, and introduces the air drawn into the rotating shaft part 5 into the water-draining basket 2.

A fourth aspect of the present invention relates to the centrifugation dewatering apparatus of the first or second aspect, and is characterized in that the air flow fin 6 that rotates in tandem with the rotation of the rotating shaft part 5 is provided between the rotating shaft part 5 and the water-draining basket 2; and that the air flow fin 6 creates an air-drawing current introduced from the exterior of the rotating shaft part 5 into the interior, and introduces the air drawn into the rotating shaft part into the water-draining basket 2.

A fifth aspect of the present invention relates to the centrifugation dewatering apparatus of the third aspect, and is characterized in that the air flow fin 6 that rotates in tandem with the rotation of the rotating shaft part 5 is provided between the rotating shaft part 5 and the water-draining basket 2; and that the air flow fin 6 creates an air-drawing current introduced from the exterior of the rotating shaft part 5 into the interior, and introduces the air drawn into the rotating shaft part 5 into the water-draining basket 2.

A sixth aspect of the present invention relates to the centrifugation dewatering apparatus of the first or second aspect, and is characterized in that the water-draining basket 2 is raisably provided to the apparatus main body 3; a port 2A for introducing the material to be dewatered 1 is provided to an upper part of the water-draining basket 2; a port 2B for extracting the material to be dewatered 1 is provided to the lower part of the water-draining basket 2; and lifting the water-draining basket 2 causes the material to be dewatered 1 to fall unassistedly and extracted via the extraction port 2B.

A seventh aspect of the present invention relates to the centrifugation dewatering apparatus of the third aspect, and is characterized in that the water-draining basket 2 is raisably provided to the apparatus main body 3; a port 2A for introducing the material to be dewatered 1 is provided to an upper part of the water-draining basket 2; a port 2B for extracting the material to be dewatered 1 is provided to the lower part of the water-draining basket 2; and lifting the water-draining basket 2 causes the material to be dewatered 1 to fall unassistedly and extracted via the extraction port 2B.

An eighth aspect of the present invention relates to the centrifugation dewatering apparatus of the fourth aspect, and is characterized in that the water-draining basket 2 is raisably provided to the apparatus main body 3; a port 2A for introducing the material to be dewatered 1 is provided to an upper part of the water-draining basket 2; a port 2B for extracting the material to be dewatered 1 is provided to the lower part of the water-draining basket 2; and lifting the water-draining basket 2 causes the material to be dewatered 1 to fall unassistedly and extracted via the extraction port 2B.

A ninth aspect of the present invention relates to the centrifugation dewatering apparatus of the fifth aspect, and is characterized in that the water-draining basket 2 is raisably provided to the apparatus main body 3; a port 2A for introducing the material to be dewatered 1 is provided to an upper part of the water-draining basket 2; a port 2B for extracting the material to be dewatered 1 is provided to the lower part of the water-draining basket 2; and lifting the water-draining basket 2 causes the material to be dewatered 1 to fall unassistedly to be extracted via the extraction port 2B.

Effect of the Invention

The structure of the present invention as described above enables centrifugation dewatering to be performed at the same time as air flow drying. The present invention is accordingly an innovative centrifugation dewatering apparatus having an extremely high degree of utility, enabling dewatering and drying of a material to be dewatered using a dewatering step that is similar to what is conventionally used, without requiring any special drying procedure or the like to be performed after dewatering has been performed.

According to the centrifugation dewatering apparatus of the second through fifth aspects, air is reliably and effectively passed through the water-draining basket, and efficient drying is performed; therefore, less time is required until drying is performed. An even higher degree of utility is accordingly achieved.

According to the invention of the third aspect, there is created an air-drawing current introduced from the exterior of the rotating shaft into the interior, and the air drawn into the interior of the rotating shaft is introduced into the water-draining basket. Therefore, air is effectively caused to flow into the water-draining basket in the periphery of the rotating shaft, and the material to be dewatered can be dried. Furthermore, the invention according to the third aspect is constituted in the manner of the invention according to the fourth and fifth aspects, whereby the aforesaid effect can be reliably demonstrated.

According to the centrifugation dewatering apparatuses of the sixth through ninth aspects, the material to be dewatered is merely extracted from the water-draining basket after having been dewatered. Therefore, the material to be dewatered is very readily conveyed to a subsequent step or the like after having been dewatered, and an even higher level of utility is achieved.

MODE FOR CARRYING OUT THE INVENTION

Figure 1:
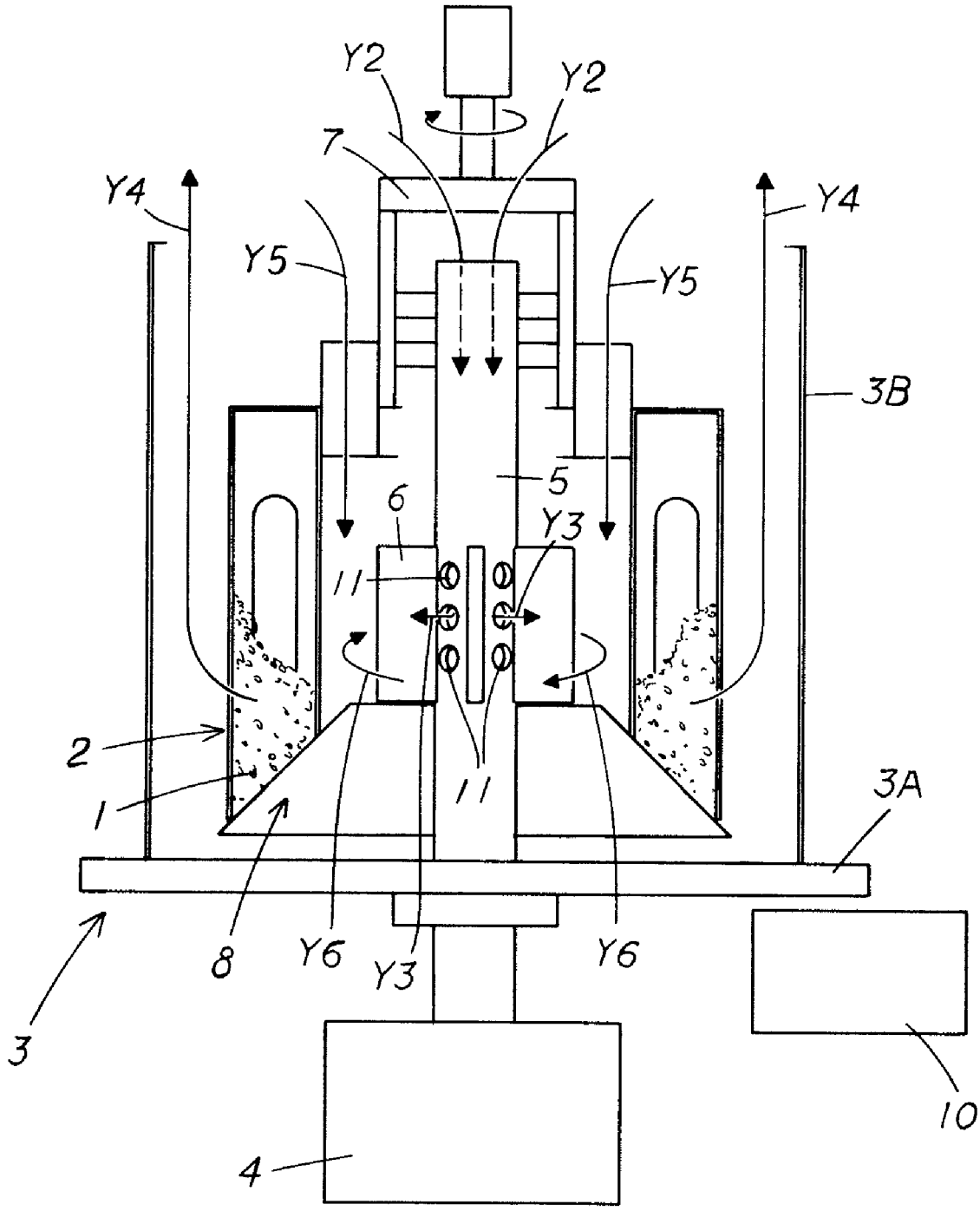
FIG. 1 is a descriptive sectional diagram in lateral view showing a state in which the present example is used (during centrifugation dewatering)

Preferred embodiments (the manner in which the present invention is implemented) of the present invention are briefly described below with reference to the diagrams while indicating the effects of the present invention.

A material to be dewatered 1 is accommodated within a water-draining basket 2, and a rotating shaft part 5 is made to rotate in an apparatus main body 3 using a drive source 4. The water-draining basket 2 is thus made to rotate together with the drive source 4, and the centrifugal force generated thereby removes water adhering to the material to be dewatered 1.

The centrifugal force will guide air present in the hollow rotating shaft part 5 into the water-draining basket 2, which communicates with the rotating shaft part 5. The material to be dewatered 1 within the water-draining basket 2 will be dried by the centrifugal force and the air flowing from the interior of the rotating shaft part 5.

If, for example, an air flow fin 6 that rotates in tandem with the rotation of the rotating shaft part 5 is provided, and the position in which the air flow fin 6 is attached as well as the configuration thereof are established so that air within the rotating shaft part 5 will be guided into the water-draining basket 2, then the air flow fin 6 will cause air to flow into the water-draining basket 2 in a reliable and highly effective manner. As a result, less time will be required until drying is performed, and the efficiency of the dewatering operation can be improved.

Centrifugation dewatering is accordingly performed at the same time as air flow drying, enabling dewatering and drying of the material to be dewatered 1 using a dewatering step that is similar to what is conventionally used, without requiring any special drying procedure or the like to be additionally performed after dewatering has been performed.

As a result, the material to be dewatered 1 will not adhere to any devices on the manufacturing line, nor will there be any incidence of impeded manufacture, or of microbes adhering to the devices. Moreover, the material to be dewatered 1 can be precisely measured, and the problems experienced in the prior art can be eliminated.

If, for example, the water-draining basket 2 is raisably provided to the apparatus main body 3; a port 2A for introducing the material to be dewatered 1 is provided to an upper part of the water-draining basket 2; a port 2B for extracting the material to be dewatered 1 is provided to the lower part of the water-draining basket 2; and lifting the water-draining basket 2 causes the material to be dewatered 1 to fall unassistedly and extracted via the extraction port 2B, the material to be dewatered 1 can be readily extracted after having been dewatered, and the material can be very readily conveyed to a subsequent step or the like. Specifically, conventional centrifugation dewatering apparatuses of such description merely have an introduction port that doubles as an extraction port and is provided to the upper part of the water-draining basket. Therefore, once the dewatering process has concluded, the material to be dewatered must be drawn upward and extracted via the upper extraction port on the water-draining basket. Not only is this operation cumbersome, narrow-profile materials to be dewatered such as rice tend to remain in the water-draining basket, while dirt and other contaminants tend to accumulate therein. However, according to the present configuration, the material to be dewatered 1 drops down unassistedly, thereby obviating any cumbersome operation such as having to draw the material upward. Furthermore, the material to be dewatered 1 is dried as described above, whereby the material does not stick to the water-draining basket 2. Greater utility is obtained for these and other reasons.

EXAMPLES

Detailed examples of the present invention are described below with reference to the diagrams.

The present example is a centrifugation dewatering apparatus wherein a water-draining basket 2 for accommodating a material to be dewatered 1 is rotatably provided to a apparatus main body 3, and the rotational driving of the water-draining basket 2 centrifugally removes any water adhering to the material to be dewatered 1.

Specifically, the apparatus main body 3 comprises a bottom plate part 3A and a cylindrical container body 3B having a cover (not shown) and being disposed on the bottom plate part 3A, as shown in FIG. 1. The cylindrical container body 3B is provided so that a power source (not shown) can control the movement thereof in a vertical direction with respect to the bottom plate part 3A (refer to arrow Y1 in FIG. 3).

A rotating shaft part 5 is vertically provided to a central region of the bottom plate part 3A in a state of vertical penetration therethrough, and is connected to a motor or other drive source 4 disposed on a bottom part of the apparatus main body 3. The rotating shaft part 5 is rotatably driven by the drive source 4. Once the centrifugation dewatering has concluded, at least the bottom plate part 3A is made to rotate using the drive source 4, and the material to be dewatered is discharged.

The rotating shaft part 5, for which a small-diameter round pipe is used, is of a hollow configuration with at least an upper end part thereof left open.

According to the present example, the water-draining basket 2, which rotates in tandem with the rotating shaft part 5, is provided to the periphery of the rotating shaft part 5.

Specifically, the water-draining basket 2 has an annular shape when viewed from the top, and is formed from a punched plate. The annular water-draining basket 2 is disposed so that the rotating shaft part 5 passes through a central part thereof, and an interposing member 7 formed in an annular shape as viewed from the top is disposed between and thereby secures the water-draining basket 2 and the rotating shaft part 5. The water-draining basket 2 is thereby provided so as to surround the periphery of the rotating shaft part 5.

The interposing member 7 rotates in tandem with the rotation of the rotating shaft part 5, and the water-draining basket 2 also rotates in tandem with the rotation of the interposing member 7.

The interposing member 7 is provided to the rotating shaft part 5 so as to be able to move vertically in the axial direction of the rotating shaft part 5 within a prescribed range. The water-draining basket 2 also moves vertically in concert with the vertical movement of the interposing member 7 (refer to arrow Y0 in FIG. 3). In an alternative configuration, the cylindrical container body 3B may also move in connection with the vertical movement of the water-draining basket 2 and the interposing member 7, so that the vertical movement is controlled.

The upper and lower parts of the water-draining basket 2 in the present example are left open, so that an upper open part is used for a port 2A for introducing the material to be dewatered 1, and a lower open part is used for a port 2B for extracting the material to be dewatered 1.

Figure 3:
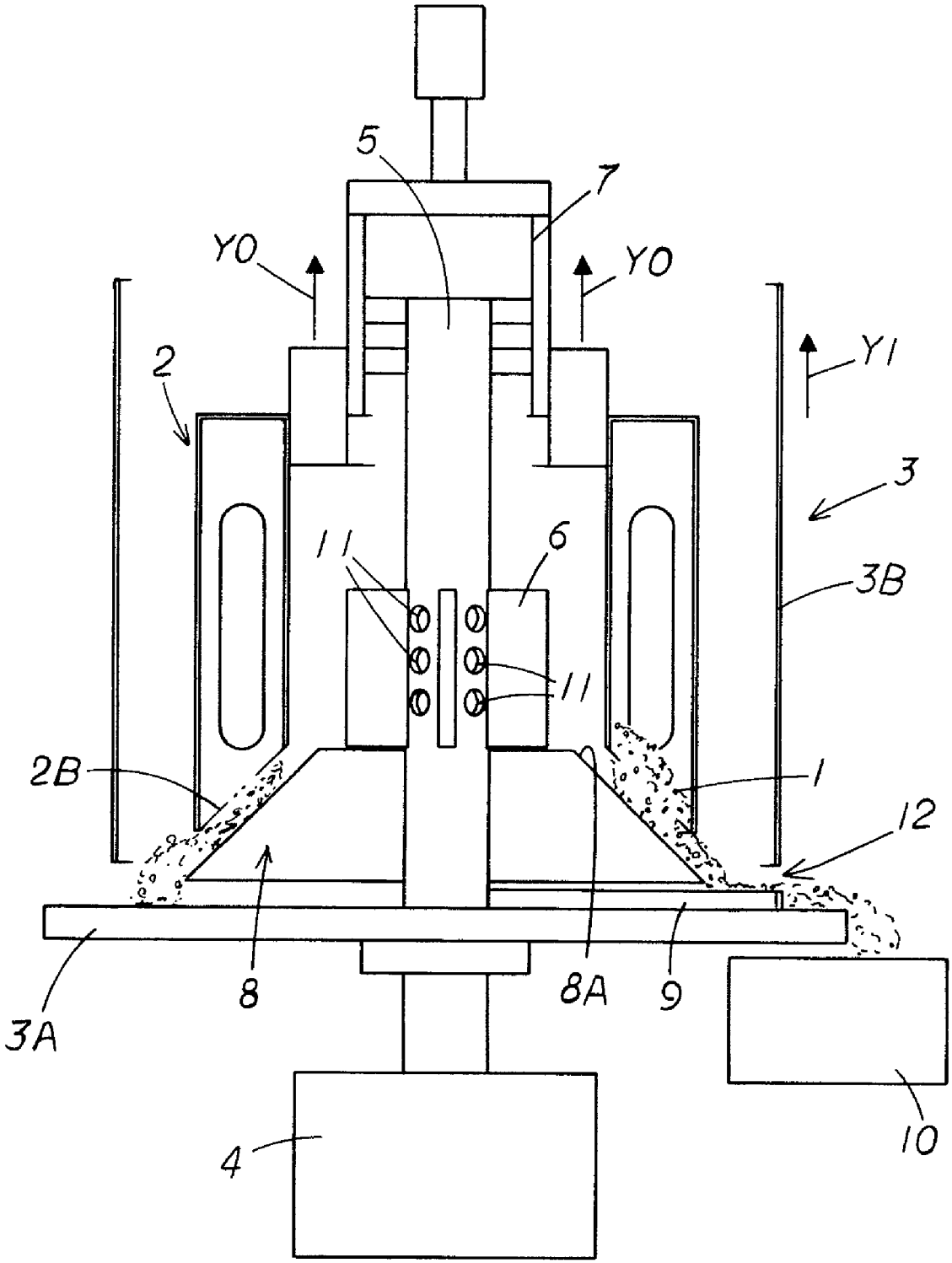
FIG. 3 is a descriptive sectional diagram in lateral view showing a state wherein the material to be dewatered has been discharged from the water-draining basket once the centrifugation dewatering process in the present embodiment has concluded.

As shown in FIGS. 1 and 3, a disc-shaped landing part 8 that rotates together with the rotating shaft part 5 is provided to the rotating shaft part 5 in a position near the bottom plate part 3A thereof. The landing part 8 forms a bottom surface onto which the material to be dewatered 1 lands after having been introduced via the port 2A and after the extraction port 2B is closed.

More specifically, the extraction port 2B of the water-draining basket 2 lands on the landing part 8 and achieves a closed state when the material to be dewatered 1 is introduced into the water-draining basket 2 as well as during the centrifugation dewatering process. Once the dewatering process has concluded, a control is made so that the cylindrical container body 3B and the water-draining basket 2 are moved upward, the extraction port 2B lifts away from the landing part 8, and the material to be dewatered 1 drops unassistedly from the extraction port 2B to be extracted.

The landing part 8 is configured so that an area on which the extraction port 2B is situated is a slanted surface 8A that slants downward toward the outer peripheral edge of the landing part 8. The material to be dewatered 1 that has fallen unassistedly via the extraction port 2B passes over the slanted surface 8A and falls onto the outer peripheral part of the bottom plate part 3A of the apparatus main body 3 under the landing part 8. The extraction port 2B is also formed in a slanted configuration that assumes a closed state when situated on the slanted surface 8A.

In the present example, the material to be dewatered 1, after having dropped onto the outer peripheral part of the bottom plate part 3A, is discharged away from the apparatus main body 3 by a discharging arm 9 that is provided to the bottom part in the interior of the apparatus main body 3.

Figure 4:
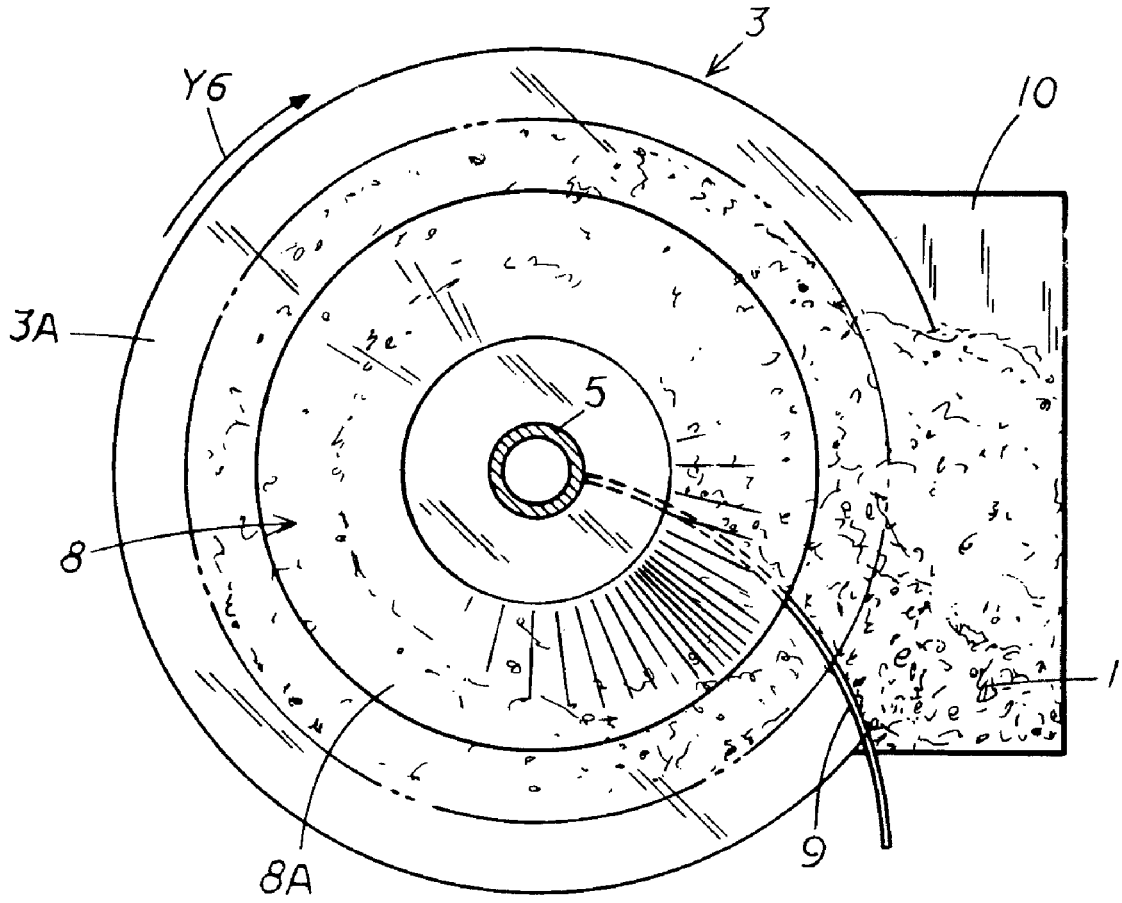
FIG. 4 is a descriptive sectional diagram of FIG. 3 in plan view.

The discharging arm 9 is provided to a vicinity of the bottom plate part 3A so as to be able to swivel horizontally over the upper surface of the bottom plate part 3A while not rotating together therewith. When the cylindrical container body 3B is moved upward, and a gap (discharging gap 12) is opened between the lower edge of the cylindrical container body 3B and the upper surface of the bottom plate part 3A, the discharging arm 9 is actuated to as to swivel from the discharging gap 12 to the interior of the apparatus main body 3, and to enter a gap formed between the landing part 8 and the bottom plate part 3A. The material to be dewatered 1 on the bottom plate part 3A is thereby guided and discharged by the discharging arm 9 toward the discharging gap 12. The material to be dewatered 1 is discharged from the discharging gap 12 toward an accommodating part 10 provided externally with respect to the apparatus main body 3 (FIG. 4).

According to the present example, the interior of the hollow rotating shaft part 5 and the interior of the water-draining basket 2 are provided in a communicating state. When the material to be dewatered 1 accommodated within the water-draining basket 2 is centrifugally dewatered by the rotation of the rotating shaft part 5 driven by the drive source 4, the air introduced into the rotating shaft part 5 is introduced into the water-draining basket 2 from the rotating shaft part 5, and the material to be dewatered 1 is dried by the flow of air and centrifugal force.

Figure 2:
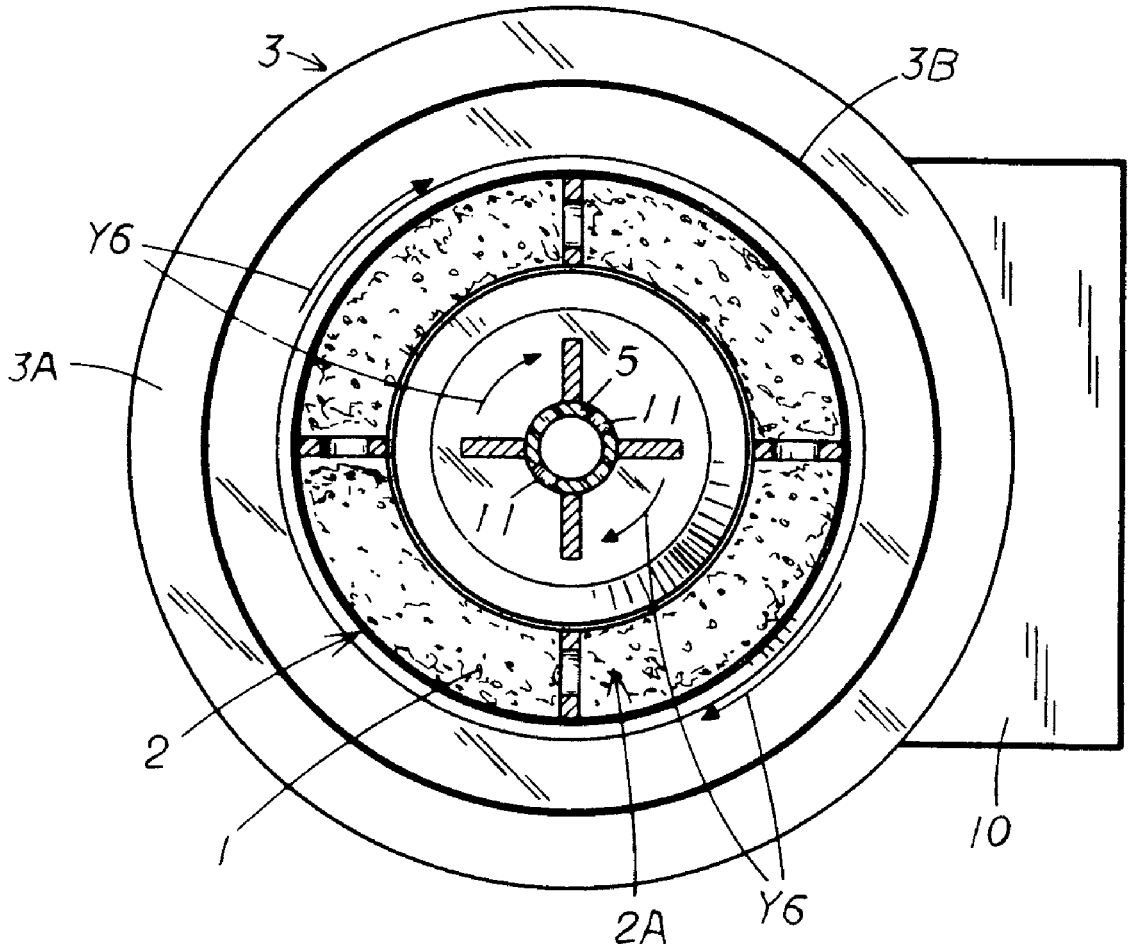
FIG. 2 is a descriptive sectional diagram of FIG. 1 in plan view.

Specifically, as shown in FIGS. 1 through 3, a plurality of through-holes 11 are provided to a peripheral surface part substantially in the center of the rotating shaft part 5. The through-holes 11 and holes punched in the water-draining basket 2 cause the interior of the rotating shaft part 5 and the interior of the water-draining basket 2 to form a communicating state interposed by a space between the rotating shaft part 5 and the water-draining basket 2.

Accordingly, a current of air is naturally produced from the air introduced into the rotating shaft part 5 moving in the radial direction thereof by the centrifugal force resulting from the rotation thereof. The current of air is thereby introduced into the surrounding water-draining basket 2. The drying action produced by the air flow (current) is applied to the material to be dewatered 1.

An air flow fin 6 that rotates in tandem with the rotation of the rotating shaft part 5 is provided in the present example. The position in which the air flow fin 6 is attached as well as the configuration thereof are established so that air within the rotating shaft part 5 is guided into the water-draining basket 2.

Specifically, the air flow fin 6 that rotates in tandem with the rotation of the rotating shaft part 5 is provided between the rotating shaft part 5 and the water-draining basket 2. The air flow fin 6 produces an air-drawing current introduced from the exterior of the rotating shaft part 5 into the interior (arrow Y2 in FIG. 1), and introduces the air drawn into the rotating shaft part 5 into the water-draining basket 2 (arrow Y3 in FIG. 1).

More specifically, the air flow fin 6, which is of an annular or other shape and causes air to flow toward the exterior of the rotating shaft part 5, is attached to an outer peripheral surface of the rotating shaft part 5 on which the through-holes are present. The air flow fin 6 sends air towards the interior of the water-draining basket 2 while rotating together with the rotating shaft part 5.

The top part of the apparatus main body 3 (cylindrical container body 3B) is provided with drawing holes (not shown) for drawing air into the rotating shaft part 5 from the exterior of the apparatus main body 3, and is provided with discharging holes (not shown) for discharging, to the exterior of the apparatus main body 3, air that has passed through the water-draining basket 2 as shown by the arrow Y4 in FIG. 1, and has risen along the inside wall surface of the cylindrical container body 3B.

In the present example, an upper space of the interposing member 7 and a space between the water-draining basket 2 and the rotating shaft part 5 are provided in a communicating state via the interposing member 7. Air is introduced from the upper space of the interposing member 7 into the space between the water-draining basket 2 and the rotating shaft part 5 (arrow Y5 in FIG. 1), and is introduced into the water-draining basket 2 by centrifugal force and the air flow fin 6.

A method for using the centrifugation dewatering apparatus of the present example shall be provided below.

In the present example, a case is indicated in which wettened rice 1 ("rice 1") is used as the material to be dewatered 1.

The top part of the apparatus main body 3 is opened, and a large quantity of rice 1 is introduced into the water-draining basket 2 via the upper introduction port 2A. The upper part of the apparatus main body 3 is then closed, and the rotating shaft part 5 is made to rotate in the apparatus main body 3 using the drive source 4. When this occurs, the water-draining basket 2, bottom plate part 3A, interposing member 7, and landing part 8 rotate together with the drive source 4 as shown by arrow Y6; and the centrifugal force generated from rotation separates and removes water that has adhered to the material to be dewatered 1 in the water-draining basket 2.

The air flow fin 6 also rotates as the rotating shaft part 5 rotates. The air flow fin 6 creates an air-drawing current (arrow Y2) that introduces air from the exterior of the rotating shaft part 5 into the interior, and introduces into the water-draining basket 2 the air that has been drawn into the rotating shaft part 5 (from arrow Y3 to Y4). Air in the upper space of the interposing member 7 is also introduced into the space between the rotating shaft part 5 and the water-draining basket 2 (arrow Y5), and is introduced into the water-draining basket 2 itself (arrow Y4).

Specifically, during the centrifugation dewatering process, the current described above is consistently generated into the apparatus main body 3. The current (the force of the air flow) and the centrifugal force separate and remove the water, but also dry the water adhering to the surface in a highly efficient manner.

Accordingly, centrifugation and drying assisted by the flow of air are performed simultaneously, thereby obviating the need to separately perform a special drying operation, but also enabling the rice 1 to be dewatered (dried) highly efficiently, reliably, and in a short period of time.

The applicant performed an experiment in which a comparison was made between the actual performance of a conventional centrifugation dewatering apparatus and the centrifugation dewatering apparatus of the present example to dewater rice 1. The results are shown in Table 1. The term "shaft only" in Table 1 refers to the conventional centrifugation dewatering apparatus, while "shaft with hole/fin" refers to the centrifugation dewatering apparatus of the present example. "Shaft with hole" refers to the centrifugation dewatering apparatus of the present example in which the air flow fin 6 is omitted in the structure thereof. "Shaft with fin" refers to the conventional centrifugation dewatering apparatus having a structure in which an air flow fin is attached to the rotating shaft part.

TABLE 1

Comparison between physical characteristics and apparent moisture (surface-adhering water and moisture in rice) derived from using different configurations Dewatering conditions (example)

| Structure | Apparent moisture (%) | Characteristics |
|---|---|---|
| Shaft only | 33.0 | Surface wet; rice adhered |
| Shaft with holes | 32.5 | Some wetness; fair degree of adherence |
| Shaft with fins | 32.5 | As above |
| Shaft with holes and fins | 32.0 | Surface dry; rice loose |

Material to be dewatered: 90% polished white rice (one hour after immersion)
Rate of centrifugal acceleration at outer wall of water-draining basket 2: 800 m/sec$^2$.
Dewatering (drying) time: 2 mins
Water temperature and room temperature: 20° C.

The results confirmed that according to the centrifugation dewatering apparatus of the present example, the surface of the rice 1 was dry, and dewatering could be performed so that the rice grains were in a loose state without adhering to one another. The structure in which the air flow fin 6 had been omitted also revealed that despite the rice not having been completely dried, it was possible to achieve a drying effect that was impossible to obtain with the conventional apparatus. Moreover, in comparison to the structure merely having the air flow fin provided to the shaft, the structure with which the air flow fin 6 caused air in the rotating shaft part 5 to flow toward the water-draining basket 2 on the periphery produced a favorable current in the apparatus main body 3, and was demonstrably more effective in drying.

Accordingly, the rice 1 that had been dewatered using the present apparatus was dry; therefore, no grains adhered to any devices on the manufacturing line, and there was no incidence of impeded manufacture or of microbes adhering to the devices. Measuring could also be performed with precision.

All of the large quantity of rice 1 was able to be dried, which yields benefits such as that water can be consistently be used in a fixed amount relative to the amount of rice 1 to be measured, and water subsequently added for cooking rice can consistently be used in a fixed amount.

Once the dewatering (drying) has concluded, a control is performed to move the cylindrical container body 3B (water-draining basket 2) upward. When this is performed, the extraction port 2B lifts off the landing part 8 (slanted surface 8A) to leave an opening, and a discharging gap 12 is formed between the lower edge of the cylindrical container body 3B and the bottom plate part 3A. The discharging arm 9 swivels and advances from the discharging gap 12 over the bottom plate part 3A and into the apparatus main body 3. The rice 1 drops unassistedly onto the slanted surface 8A as a result of the opening of the extraction port 2B. However, the rice will be dry at this time, and therefore will flow out and downward very smoothly, without any grains remaining stuck to the interior of the water-draining basket 2, or any grains sticking together.

The rice 1 will pass over the slanted surface 8A and further drop onto the outer peripheral part of the lower bottom plate part 3A. The spinning of the bottom plate part 3A (arrow Y6) will cause the rice 1 to be discharged and guided into the discharging gap 12 by the discharging arm 9, and accommodated in an accommodating part 10. If the angle of inclination of the slanted surface 8A is set to approximately 45 to 60°, the rice 1 will fall smoothly onto the slanted surface 8A while being neatly dispersed. A process for loosely separating the rice in a subsequent step or the like will be unnecessary. Accordingly, setting the inclination angle of the slanted surface 8A as described above is highly effective for an apparatus that is used to subject rice 1 to centrifugation dewatering. The rice 1 can also be extracted even if the landing part 8 (slanted surface 8A) is slid downward; however, the water-draining basket 2 is moveably disposed because it is an object for a gap to be formed as a result of the water-draining basket 2 and landing part 8 being raised or lowered relative to one another, and for the extraction port 2B to be provided.

According to the present example, therefore, the entire process up to the point where the dewatered rice 1 is extracted can be performed automatically after merely performing an initial operation in which the rice 1 is introduced via the upper introduction port 2A of the water-draining basket 2. The operation is extremely straightforward and provides exceptional utility.

The present example is not provided by way of limitation in regard to the present invention; a specific constitution of a variety of structural elements may be suitably designed.

The invention claimed is:

1. A centrifugation dewatering apparatus wherein a water-draining basket for accommodating a material to be dewatered is rotatably provided to an apparatus main body, and the water-draining basket is rotatably driven, thereby centrifugally removing moisture that has adhered to the material to be dewatered, the centrifugation dewatering apparatus being characterized in that a hollow rotating shaft part that is caused to rotate using a drive source is vertically provided to the apparatus main body; the water-draining basket, which rotates in tandem with the rotating shaft part, is provided to the periphery of the rotating shaft part; the interior of the hollow rotating shaft part and the interior of the water-draining basket are provided in a communicating state; air introducted into the rotating shaft part is introduced into the water-draining basket via the interior of the rotating shaft part when the material to be dewatered that is accommodated in the water-draining basket is centrifugally dewatered by the rotation of the rotating shaft part driven by the drive source; the water-draining basket is raisable provided to the apparatus main body; a port for introducing the material to be dewatered is provided to an upper part of the water draining basket; a port for extracting the material to be dewatered is provided to a lower part of the water-draining basket; a landing part that ortates together with the rotating shaft part is provided to the rotating shaft part, said landing part forming a bottom surface onto which the material to be dewatered lands after having introduced in the water-draining basket via the port and after the extraction port is closed; and lifting the water draining basket causes the extraction port to be lifted away from the landing part thereby the material is tto dewatered falls unassistedly to be extracted from the extraction port.

2. The centrifugation dewatering apparatus according to claim 1, characterized in that the air flow fin that rotates in tandem with the rotation of the rotating shaft part is provided between the rotating shaft part and the water-draining basket; and that the air flow fin creates an air-drawing current that is introduced from the exterior of the rotating shaft part into the interior, and that introduces the air drawn into the rotating shaft part into the water-draining

3. The centrifugation dewatering apparatus according to claim 1, characterized in that an air flow fin that rotates in tandem with the rotation of the rotating shaft part is provided; and in that a position in which the air flow fin is attached as well as a configuration thereof are established so that air within the rotating shaft part is introduced into the water-draining basket.

4. The centrifligation dewatering apparatus according to claim 3, characterized in that the air flow fin that rotates in tandem with the rotation of the rotating shaft part is provided; and that the air flow fin creates an air-drawing current that is introduced from the exterior of the rotating shaft part into the interior, and introduces the air drawn into the rotating shaft part into the water-draining basket.

5. The centrifugation dewatering apparatus according to claim 4, characterized in that the air flow fin that rotates in tandem with the rotation of the rotating shaft part is provided between the rotating shaft part and the water-draining basket; and that the air flow fin creates an air-drawing current introduced from the exterior of the rotating shaft part into the interior, and introduces the air drawn into the rotating shaft part into the water-draining basket.

* * * * *

UNITED STATES PATENT AND TRADEMARK OFFICE

CERTIFICATE OF CORRECTION

PATENT NO. : 7,967,150 B2
APPLICATION NO. : 11/915449
DATED : June 28, 2011
INVENTOR(S) : Akira Yamazaki, Yoshimi Ohtaki and Masaki Takato It is certified that error appears in the above-identified patent and that said Letters Patent is hereby corrected as shown below:

Column 1, line 14
Delete "wettened" and insert --wetted--

Insert the following sentence after line 14 of Column 2:
--The water-draining basket 2 is raisably provided to the apparatus main body 3; a port 2A for introducing the material to be dewatered 1 is provided to an upper part of the water-draining basket 2; a port 2B for extracting the material to be dewatered 1 is provided to lower part of the water-draining basket 2; and lifting the water-draining basket 2 causes the material to be dewatered 1 to fall unassistedly to be extracted from the extraction port 2B.--

Column 2, line 40, after "part"
Insert --5--

Delete Column 2, line 50 to Column 3, line 23

Insert the following sentence after line 35 of Column 3:
--According to the present invention, the material to be dewatered is readily extracted from the water-draining basket after having been dewatered. Therefore, conveying the material to be dewatered to a subsequent step or the like after dewatering is very readily accomplished, resulting in a centrifugation dewatering apparatus whose configuration affords an even higher level of utility.--

Delete Column 3, lines 53 to 59

Column 4, line 9
Insert --BEST-- before "MODE FOR..."

Column 4, line 56
Delete "and" and insert --to be--

Signed and Sealed this
Twenty-eighth Day of February, 2012

David J. Kappos

David J. Kappos
*Director of the United States Patent and Trademark Office*

Column 7,
Delete “wettened” bridged between lines 49 and 50,
Insert --wetted--

Column 10,
Claim 2, last line, after “water-draining”
Insert --basket--

UNITED STATES PATENT AND TRADEMARK OFFICE

CERTIFICATE OF CORRECTION

PATENT NO. : 7,967,150 B2
APPLICATION NO. : 11/915449
DATED : June 28, 2011
INVENTOR(S) : Akira Yamazaki, Yoshimi Ohtaki and Masaki Takato It is certified that error appears in the above-identified patent and that said Letters Patent is hereby corrected as shown below:

Column 1, line 14
Delete "wettened" and insert --wetted--

Insert the following sentence after line 14 of Column 2:
--The water-draining basket 2 is raisably provided to the apparatus main body 3; a port 2A for introducing the material to be dewatered 1 is provided to an upper part of the water-draining basket 2; a port 2B for extracting the material to be dewatered 1 is provided to lower part of the water-draining basket 2; and lifting the water-draining basket 2 causes the material to be dewatered 1 to fall unassistedly to be extracted from the extraction port 2B.--

Column 2, line 40, after "part"
Insert --5--

Delete Column 2, line 50 to Column 3, line 23

Insert the following sentence after line 35 of Column 3:
--According to the present invention, the material to be dewatered is readily extracted from the water-draining basket after having been dewatered. Therefore, conveying the material to be dewatered to a subsequent step or the like after dewatering is very readily accomplished, resulting in a centrifugation dewatering apparatus whose configuration affords an even higher level of utility.--

Delete Column 3, lines 53 to 59

Column 4, line 9
Insert --BEST-- before "MODE FOR..."

This certificate supersedes the Certificate of Correction issued February 28, 2012.

Signed and Sealed this
Twenty-seventh Day of March, 2012

David J. Kappos

David J. Kappos
*Director of the United States Patent and Trademark Office*

Column 4, line 56
Delete “and” and insert --to be--

Column 7,
Delete “wettened” bridged between lines 49 and 50,
Insert --wetted--

Column 10, line 34 (Claim 2, line 8)
after “water-draining”
Insert --basket--